US008102236B1

(12) United States Patent
Fontana, Jr. et al.

(10) Patent No.: US 8,102,236 B1
(45) Date of Patent: Jan. 24, 2012

(54) THIN FILM INDUCTOR WITH INTEGRATED GAPS

(75) Inventors: Robert E. Fontana, Jr., San Jose, CA (US); William J. Gallagher, Ardsley, NY (US); Philipp Herget, San Jose, CA (US); Bucknell C. Webb, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 12/968,118

(22) Filed: Dec. 14, 2010

(51) Int. Cl.
*H01F 5/00* (2006.01)

(52) U.S. Cl. ..... 336/200

(58) Field of Classification Search ..... 336/65, 336/83, 200, 232, 178; 257/531
See application file for complete search history.

(56) References Cited

U.S. PATENT DOCUMENTS

| | | | | |
|---|---|---|---|---|
| 5,450,755 | A * | 9/1995 | Saito et al. | 73/763 |
| 5,751,522 | A | 5/1998 | Yamada et al. | |
| 5,847,634 | A * | 12/1998 | Korenivski et al. | 336/200 |
| 7,061,359 | B2 * | 6/2006 | Ding et al. | 336/200 |
| 7,463,131 | B1 * | 12/2008 | Hwang et al. | 336/200 |
| 7,755,463 | B2 * | 7/2010 | Hopper et al. | 336/200 |
| 2005/0120543 | A1 | 6/2005 | Wang et al. | |
| 2005/0146411 | A1 | 7/2005 | Gardner | |
| 2005/0206487 | A1 | 9/2005 | Honsberg-Riedl et al. | |
| 2008/0238601 | A1 | 10/2008 | Das et al. | |
| 2008/0238602 | A1 | 10/2008 | Schrom et al. | |
| 2009/0015363 | A1 | 1/2009 | Gardner | |
| 2009/0038142 | A1 | 2/2009 | Hopper et al. | |
| 2009/0323209 | A1 | 12/2009 | Kiyono | |

FOREIGN PATENT DOCUMENTS

EP 0548511 A1 6/1993

OTHER PUBLICATIONS

Yamaguchi et al. "Magnetic Thin-Film Inductors for RF-integrated Circuits," 2000 Elsevier Science, B.V., Journal of Magnetism and Magnetic Materials, vol. 215-216, 2000, pp. 807-810.

Kim et al., "A Megahertz Switching DC/DC Converter Using FeBn Thin Film Inductor," 2002 IEEE, IEEE Transactions on Magnetics, vol. 38, No. 5, Sep. 2002, pp. 3162-3164.

Gardner et al., "Integrated On-Chip Inductors Using Magnetic Material (invited)," 2008 American Institute of Physics, Journal of Applied Physics, vol. 103, 2008, pp. 1-6.

* cited by examiner

*Primary Examiner* — Tuyen Nguyen
(74) *Attorney, Agent, or Firm* — Zilka-Kotab, PC

(57) ABSTRACT

A thin film inductor according to one embodiment includes one or more arms; one or more conductors passing through each arm; a first ferromagnetic yoke wrapping partially around the one or more conductors in a first of the one or more arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a low reluctance path in the via regions; and one or more non-magnetic gaps between the top section and the bottom section in at least one of the via regions. Additional systems and methods are also provided.

25 Claims, 7 Drawing Sheets

THIN FILM INDUCTOR WITH INTEGRATED GAPS

BACKGROUND

The present invention relates to ferromagnetic inductors, and more particularly, this invention relates to thin film ferromagnetic inductors for power conversion.

The integration of inductive power converters onto silicon is one path to reducing the cost, weight, and size of electronics devices. The main challenge to developing a fully integrated "on silicon" power converter is the development of high quality thin film inductors. To be viable, the inductors should have a high Q, a large inductance, and a large energy storage per unit area.

SUMMARY

A thin film inductor according to one embodiment includes one or more arms; one or more conductors passing through each arm; a first ferromagnetic yoke wrapping partially around the one or more conductors in a first of the one or more arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a low reluctance path in the via regions; and one or more non-magnetic gaps between the top section and the bottom section in at least one of the via regions.

A system according to one embodiment includes an electronic device; and a power supply incorporating a thin film inductor. The thin film inductor includes at least two arms; one or more conductors passing through each arm; a first ferromagnetic yoke wrapping partially around the one or more conductors in a first of the arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a first low reluctance path in the via regions; and one or more non-magnetic gaps between the top section and the bottom section in at least one of the via regions of the first arm; a second ferromagnetic yoke wrapping partially around the one or more conductors in a second of the arms, the second ferromagnetic yoke comprising a magnetic top section, a magnetic bottom section, and via regions positioned on opposites sides of the one or more conductors in the second of the one or more arms, wherein the magnetic top section and magnetic bottom section are coupled together through a second low reluctance path in the via regions; and one or more non-magnetic gaps between the top section and the bottom section in at least one of the via regions of the second arm.

A method of making a thin film inductor according to one embodiment includes forming bottom sections of two yokes; forming a first layer of electrically insulating material over at least a portion of each of the two bottom sections; forming one or more conductors passing over each of the bottom sections; forming a second layer of electrically insulating material above the one or more conductors; and forming top sections of the two yokes, wherein one or more non-magnetic gaps are present in one or more via regions, the via regions being positioned on each side of the one or more conductors between the top section and the bottom section of each yoke.

Other aspects and embodiments of the present invention will become apparent from the following detailed description, which, when taken in conjunction with the drawings, illustrate by way of example the principles of the invention.

DETAILED DESCRIPTION

Figure 1:
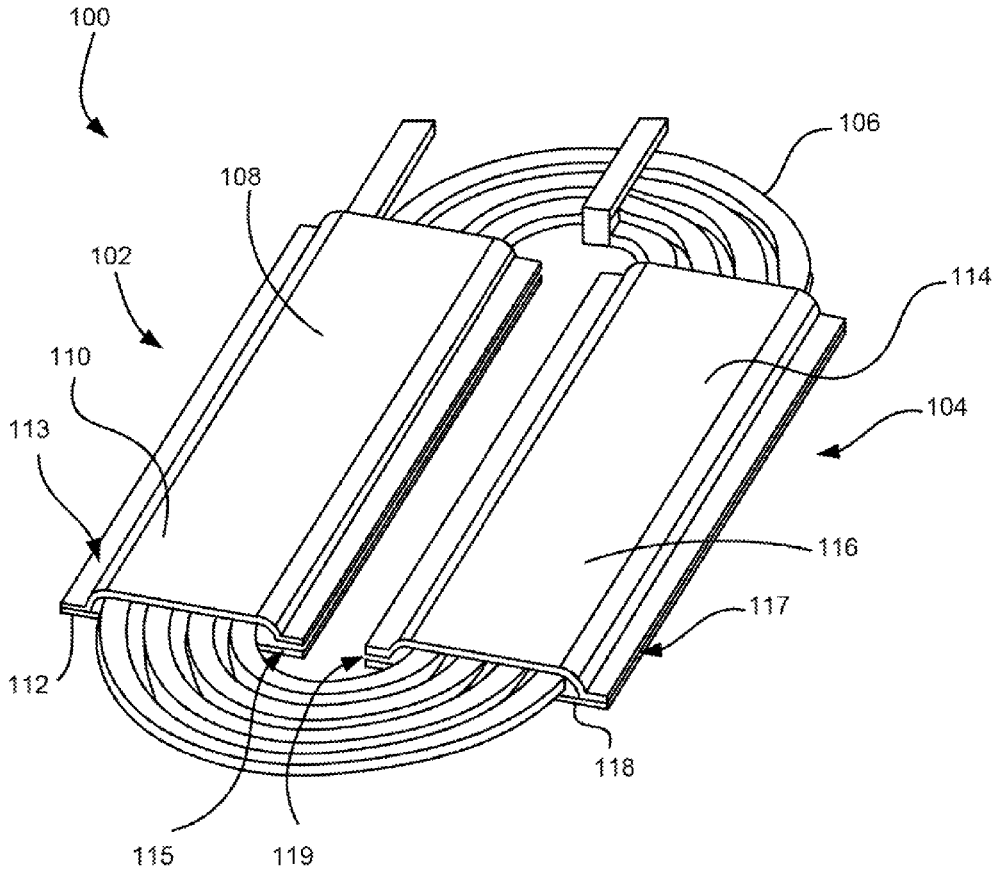
FIG. 1 is a perspective view of a thin film inductor according to one embodiment.

The following description is made for the purpose of illustrating the general principles of the present invention and is not meant to limit the inventive concepts claimed herein. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc.

It must also be noted that, as used in the specification and the appended claims, the singular forms "a," "an" and "the" include plural referents unless otherwise specified.

In the drawings, like elements have common numbering across the various Figures.

The following description discloses several preferred embodiments of thin film inductor structures having a ferromagnetic yoke with a magnetic top section and a magnetic bottom section sandwiching a conductor. On both sides of the conductor are via regions where the magnetic top section and magnetic bottom section are coupled through a low reluctance path. One or more of the via regions also has a non-magnetic gap. The non-magnetic gap functions to store energy and increase the current at which the ferromagnetic yoke saturates. The resulting inductor stores more energy per unit area.

In one general embodiment, a thin film inductor includes one or more arms; one or more conductors passing through each arm; a first ferromagnetic yoke wrapping partially around the one or more conductors in a first of the one or more arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a low reluctance path in the via regions; and one or more non-magnetic gaps between the top section and the bottom section in at least one of the via regions.

In another general embodiment, a system includes an electronic device; and a power supply incorporating a thin film inductor. The thin film inductor includes at least two arms; one or more conductors passing through each arm; a first ferromagnetic yoke wrapping partially around the one or more conductors in a first of the arms, the first ferromagnetic yoke comprising a magnetic top section, a magnetic bottom section, and via regions positioned on opposites sides of the one or more conductors, wherein the magnetic top section and magnetic bottom section are coupled together through a first low reluctance path; and one or more non-magnetic gaps between the top section and the bottom section in the first arm. A second ferromagnetic yoke wraps partially around the one or more conductors in a second of the arms, the second ferromagnetic yoke comprising a magnetic top section, a magnetic bottom section, and via regions positioned on opposites sides of the one or more conductors, wherein the magnetic top section and magnetic bottom section are coupled together through a second low reluctance path; and one or more non-magnetic gaps between the top section and the bottom section in the second arm.

In yet another general embodiment, a method of making a thin film inductor includes forming bottom sections of two yokes; forming a first layer of electrically insulating material over at least a portion of each of the two bottom sections; forming one or more conductors passing over each of the bottom sections; forming a second layer of electrically insulating material above the one or more conductors; and forming top sections of the two yokes, wherein one or more non-magnetic gaps are present in one or more via regions, the via regions being positioned on each side of the one or more conductors between the top section and the bottom section of each yoke.

To efficiently convert power, inductors need to have a low loss. Additionally, thin film inductors need to store a large amount of energy per unit area to fit in the limited space on silicon. A ferromagnetic material enables an inductor to store more energy for a given current. Another benefit of a ferromagnetic material is a reduction in losses. One of the main loss mechanisms in an inductor comes from the resistance of the conductors. This loss is proportional to the square of the current. Using a ferromagnetic material reduces the current required to store a given amount of power and thus reduces the losses.

However, ferromagnetic materials also introduce some disadvantages. The magnitude of the fields in a ferromagnetic material is limited by saturation. The saturation of the yoke therefore limits the maximum current and the maximum energy that the inductor can store. Additionally, magnetic materials operating at high frequency produce losses through eddy currents and hysteresis. These losses can be substantial if the inductor is operated at a very high frequency.

By placing a small gap or gaps in the magnetic material, some of the limitations of the magnetic material can be overcome. The gaps act to store energy and reduce the fields in the magnetic yokes. This increases the saturation current and increases the energy storage of the device without having an impact on device size. In addition, the extra energy is stored in the air gap does not create any magnetic losses. If the magnetic core losses are high, this can reduce the total loss in the system and increase Q.

In one embodiment, an inductor structure has multiple arms with one or more electrical conductors each having one or more turns passing through each arm. Each of the arms is surrounded by a ferromagnetic yoke containing one or more gaps.

The gaps are placed perpendicular to the direction the flux takes through the yoke. They act to store energy and increase the current required to saturate the inductor. The gaps thus allow the inductor to store more energy per unit area than it would be able to without the gaps.

Referring to FIG. 1, there is shown a thin film inductor 100 having two arms 102, 104 and a conductor 106 passing through each arm. The conductor in this case has several turns in a spiral configuration, but in other approaches may have a single turn. In further approaches, multiple conductors, each having one or more turns, may be employed.

A first ferromagnetic yoke 108 wraps partially around the one or more conductors in a first of the arms 102. The first ferromagnetic yoke includes a magnetic top section 110 and a magnetic bottom section 112. On either side of the conductor 106 are via regions 113 and 115, where the magnetic top section 110 and magnetic bottom section 112 are coupled through a low reluctance path. One or more of the via regions also has a non-magnetic gap. In this embodiment, the low reluctance path is created by minimizing the separation between the top and bottom poles in the via regions. Several illustrative gap configurations are presented in detail below.

A second ferromagnetic yoke 114 wraps partially around the one or more conductors in a second of the arms 104. The second ferromagnetic yoke includes a magnetic top section 116 and a magnetic bottom section 118 magnetically coupled to the magnetic top section of the second ferromagnetic yoke, and having one or more non-magnetic gaps between the top section and the bottom section in one or more of the via regions 117, 119 where the top section and magnetic bottom section are coupled together through a low reluctance path.

Figure 2:
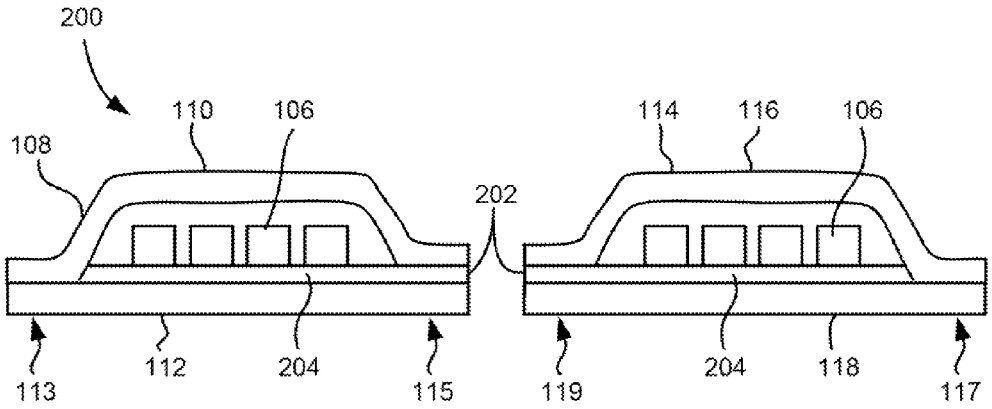
FIG. 2 is a cross sectional view of a thin film inductor according to one embodiment.

FIG. 2 depicts a cross section of the thin film inductor 100 having one particular gap configuration. The inductor 200 has two ferromagnetic yokes, each yoke having a single non-magnetic gap 202 in the inner via regions 115, 119. As shown, in some approaches, the non-magnetic gap of each ferromagnetic yoke is located on an inside of the thin film inductor. In other words, the gaps may face each other or otherwise be positioned towards the middle of the thin film inductor. This approach may be preferred where it is desirable to maintain the fringing fields surrounding the gaps near the center of the inductor rather than towards its external periphery in the outer vias regions 113, 117, such as where such fringing fields could interfere with other nearby components.

With continued reference to FIG. 2, the coils may be separated from the bottom section of each yoke by a layer of electrically insulating material 204. The electrically insulating material may, in this and other embodiments, form the one or more non-magnetic gaps. Preferably, the layer of electrically insulating material has physical and structural characteristics of being created by a single layer deposition. For example, the electrically insulating material may have a structure having no transition or interface that would be characteristic of multiple deposition processes; rather the layer is a single contiguous layer without such transition or interface. Such layer may be formed by a single deposition process such as sputtering, spincoating, etc. that forms the layer of electrically insulating material to the desired thickness, or greater than the desired thickness (and subsequently reduced via a subtractive process such as etching, etc.).

Figure 3:
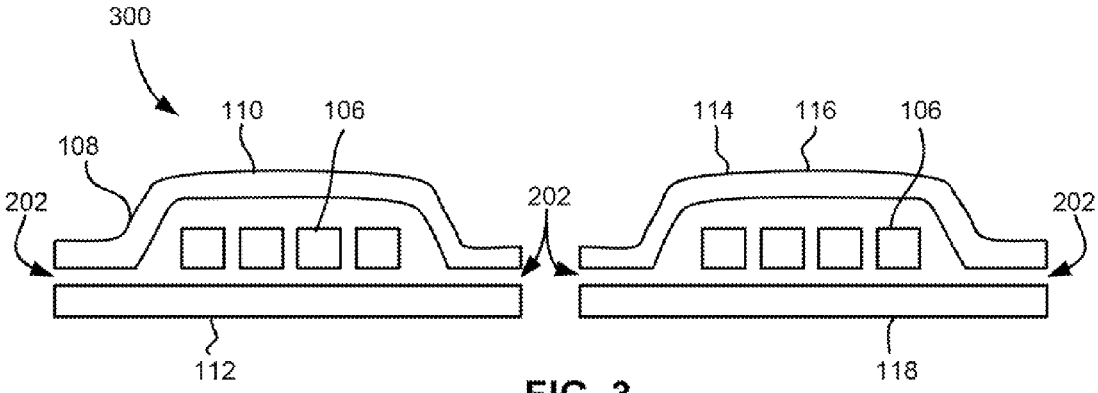
FIG. 3 is a cross sectional view of a thin film inductor according to one embodiment.

FIG. 3 depicts a cross section of a thin film inductor 300 having yet another gap configuration. In this configuration the inductor has two ferromagnetic yokes, where the top section and bottom section of each yoke are separated by two non-magnetic gaps.

Figure 4:
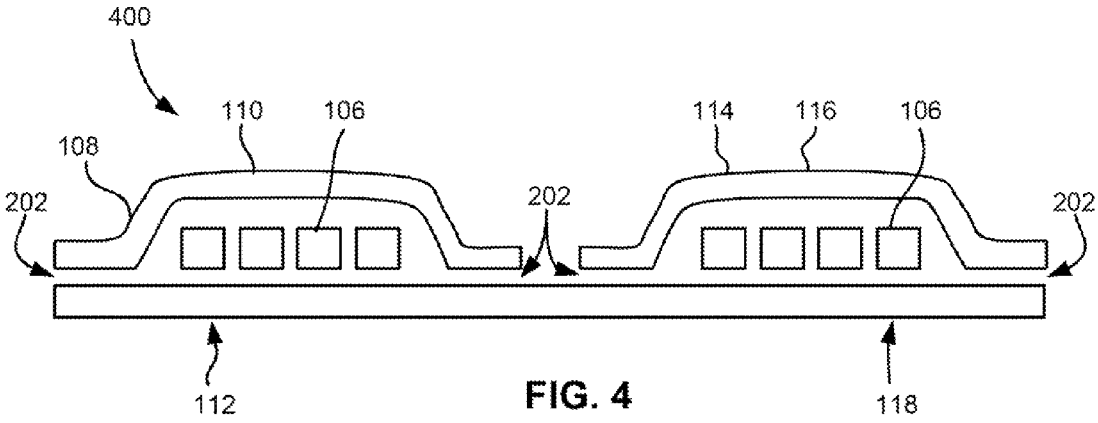
FIG. 4 is a cross sectional view of a thin film inductor according to one embodiment.
Figure 5:
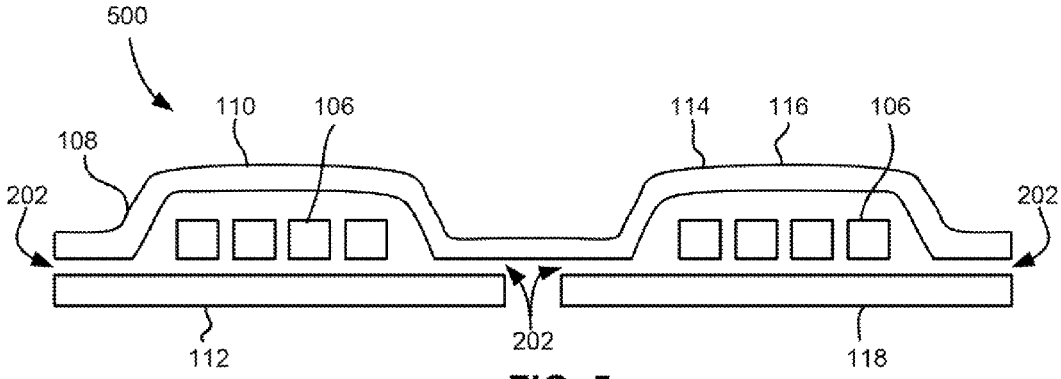
FIG. 5 is a cross sectional view of a thin film inductor according to one embodiment.

In some approaches, compatible with any of the various designs of the present invention, at least one of the top sections and the bottom sections of the first and second yokes is continuous across the first and second yokes. For example, FIG. 4 depicts a thin film inductor 400 having two ferromagnetic yokes, where the top section and bottom section of each yoke are separated by two non-magnetic gaps, and where the bottom section of the yoke is a single, contiguous piece. FIG. 5 depicts a cross section of a thin film inductor 500 having two ferromagnetic yokes, where the top section and bottom section of each yoke are separated by two non-magnetic gaps, and where the top section of the yoke is a single, contiguous piece. In a further embodiment, both the top and bottom sections may be continuous.

Figure 6A:
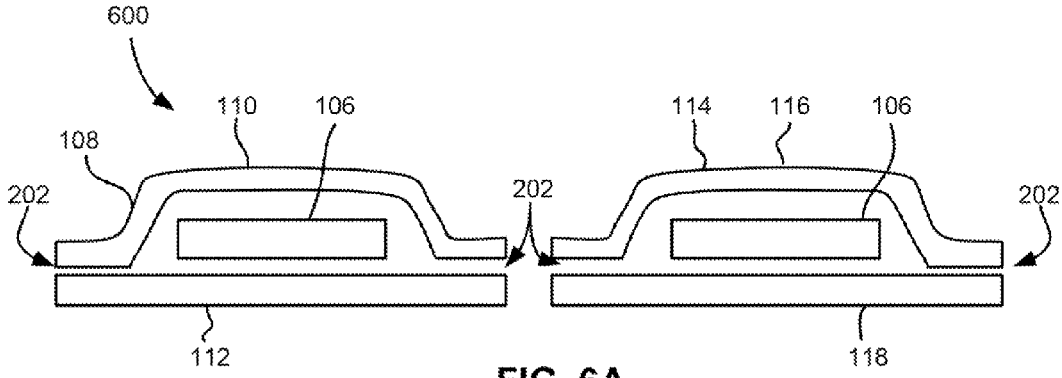
FIG. 6A is a cross sectional view of a thin film inductor according to one embodiment.

FIG. 6A depicts a cross section of a thin film inductor 600 having two ferromagnetic yokes, where the top section and bottom section of each yoke are separated by non-magnetic gaps of different thicknesses, where thickness refers to the deposition thickness of the gap material. Also depicted in FIG. 6A is an illustrative conductor having a single turn. The larger of the two gaps can be defined by two deposition processes, while the smaller of the two gaps is defined by one deposition process.

Figure 6B:
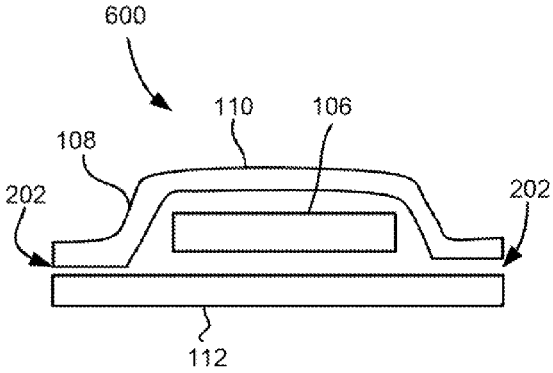
FIG. 6B is a cross sectional view of a thin film inductor according to one embodiment.

FIG. 6B depicts a cross section of a thin film inductor 650 having a single arm, a single conductor with one turn and a single ferromagnetic yoke, where the top section and bottom section of the yoke are separated by non-magnetic gaps of different thicknesses, where thickness refers to the deposition thickness of the gap material. Of course, such an embodiment may have features similar to any other configuration, such as found in FIGS. 1-6A and 7-8, as would be apparent to one skilled in the art upon reading the present disclosure.

In the embodiments described with reference to FIGS. 2-6, the top section of each yoke is conformal. In other words, the top sections generally have a cross sectional profile that conforms to the shape of the underlying structure.

Figure 7:
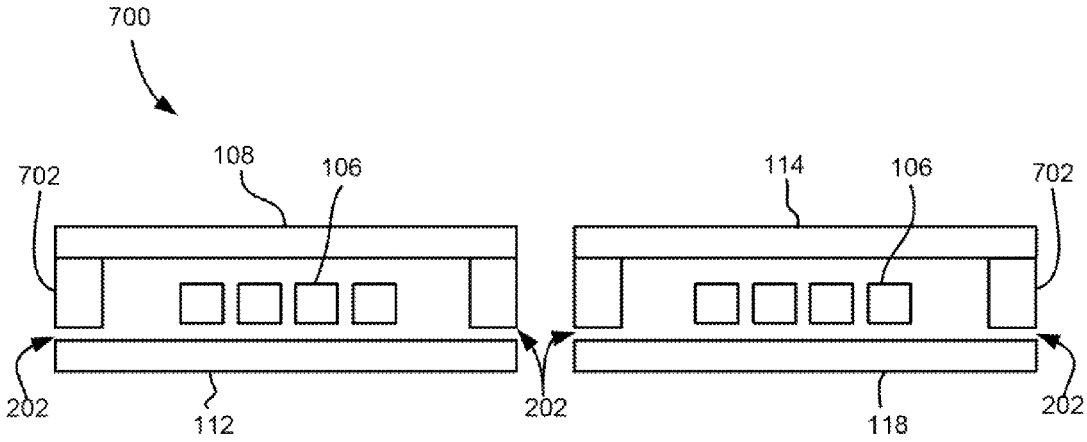
FIG. 7 is a cross sectional view of a thin film inductor according to one embodiment.
Figure 8:
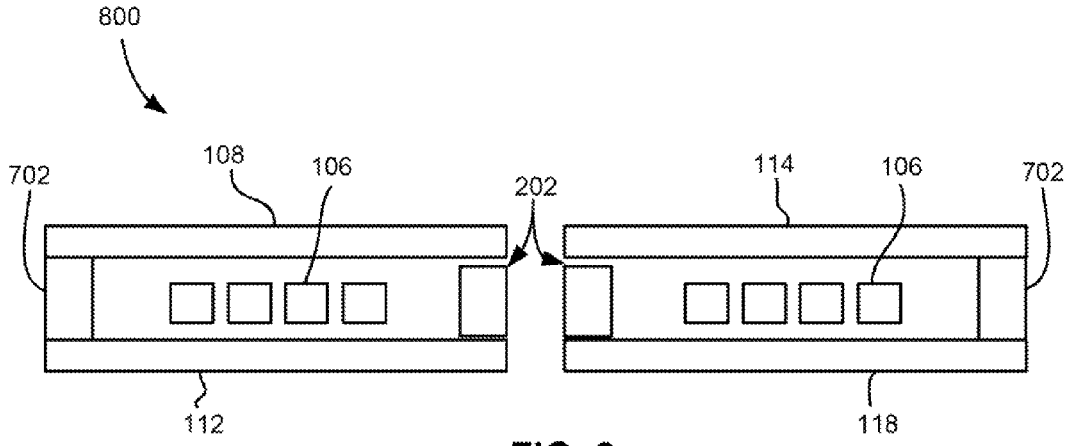
FIG. 8 is a cross sectional view of a thin film inductor according to one embodiment.

Referring to FIGS. 7 and 8, thin film inductors 700, 800 respectively, are depicted as having a planar top section of each yoke and pillars 702 of magnetic material extending between the top and bottom section of each yoke. In this embodiment, the low reluctance path is created by using two additional magnetic pillar structures between the top and bottom sections in the via regions. These magnetic pillars allow flux to flow between the top and bottom poles. Preferably, at least one end of each pillar is in contact with the top and/or bottom section of the associated yoke. As shown in FIG. 7, one or more nonmagnetic gaps of each yoke may be positioned at the bottom of the pillar or pillars. As shown in FIG. 8, one or more nonmagnetic gaps of each yoke may be positioned at the top of the pillar or pillars.

Figure 9:
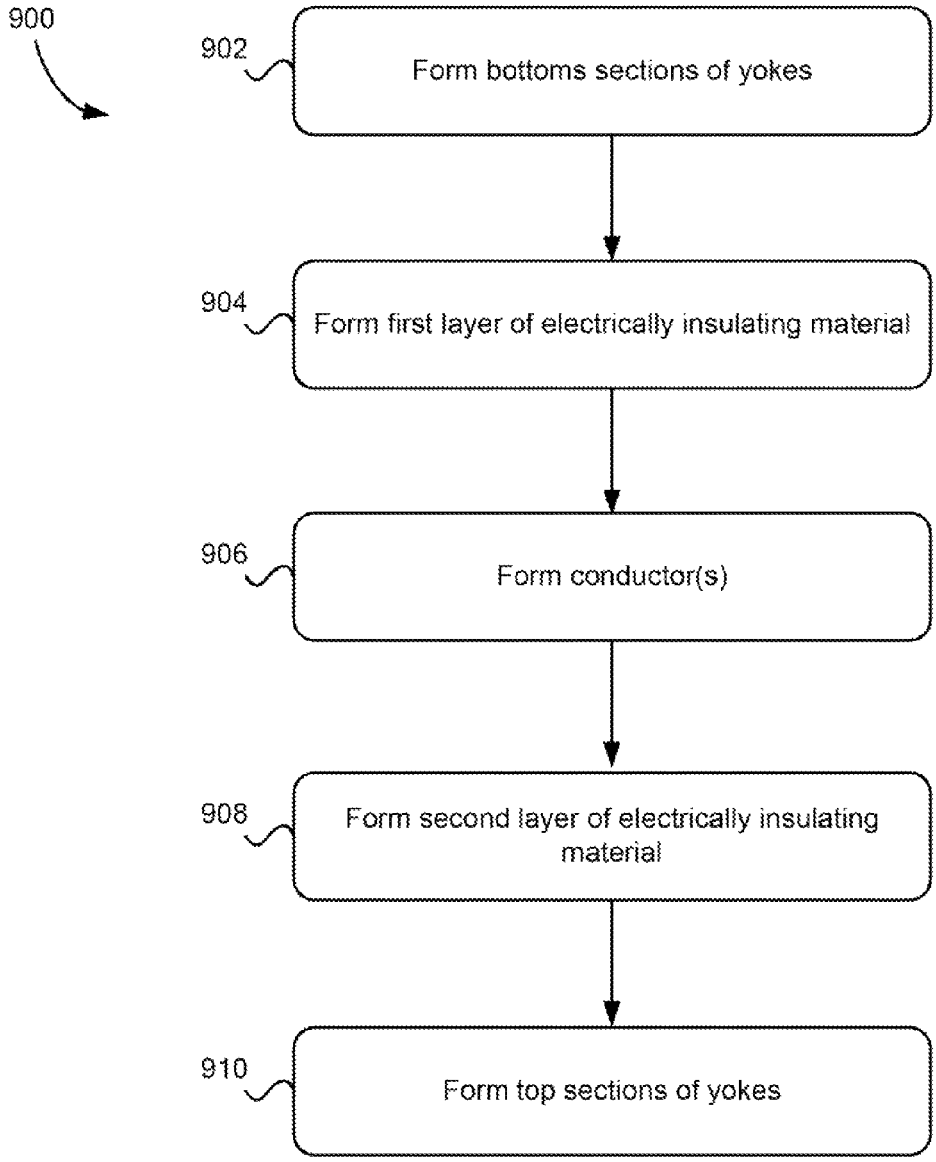
FIG. 9 is a flowchart of a method according to one embodiment.

A method 900 of making a thin film inductor according to one embodiment is depicted in FIG. 9. The method 900, in some approaches, may be performed in any desired environment, and may include embodiments and/or approaches described in relation to FIGS. 1-8. Of course, more or less operations than those shown in FIG. 9 may be performed as would be known to one of skill in the art.

In step 902, bottom sections of two yokes are formed. Any suitable process may be used, such as plating, sputtering, masking and milling, etc. The top and bottom sections of the yokes may be constructed of any soft magnetic material, such as iron alloys, nickel alloys, cobalt alloys, ferrites, etc. The top and/or bottom sections of the yokes may be characteristic of a continuously-formed layer, or may be a laminate of magnetic and nonmagnetic layers, e.g., alternating magnetic and nonmagnetic layers. The non-magnetic layers would preferably include non-conductive materials, although embodiments with conductive non-magnetic layers are also possible. Moreover, as noted above with reference to FIG. 4, the bottom sections may be portions of a continuous layer of magnetic material.

In step 904 of FIG. 9, a first layer of electrically insulating material is formed over at least a portion of each of the two bottom sections. Any suitable process may be used, such as sputtering, spincoating, etc. Any electrically insulating material known in the art may be used, such as alumina, silicon oxides, resists, polymers, etc. This layer may also be comprised of multiple layers of differing or similar materials so long as it is non magnetic and non conductive. The layer may optionally be used to create the gaps in the ferromagnetic yoke. The layer may also be patterned to allow gaps to be formed only where they are intended to be placed.

In step 906, one or more conductors passing over each of the bottom sections and first layer of electrically insulating material is formed. The conductor(s) may be constructed of any electrically conductive material, such as copper, gold, aluminum, etc. Any known fabrication technique may be used, such as plating through a mask, Damascene processing, conductor printing, sputtering, masking and milling etc.

In step 908, a second layer of electrically insulating material is formed above the one or more conductors. The second layer of electrically insulating material may be formed in a similar manner and/or composition as the first layer of electrically insulating material, or it may include a different material.

In step 910, top sections of the two yokes are formed. The top sections may be formed in a similar manner and/or composition as the bottom sections. In some approaches, the top sections may have a different composition than the bottom sections.

One or more non-magnetic gaps are present between the top section and the bottom section of each yoke. These gaps may be formed as separate layers, as a by-product of another layer, etc. Any known process may be used, such as plating, sputtering, etc.

In some embodiments, the non-magnetic gaps may be made of an electrically insulating material known in the art such as metal oxides such as alumina, silicon oxides, resists, polymers, etc. In one approach, the first layer of electrically insulating material also forms one or more of the non-magnetic gaps. The first layer of electrically insulating material may have physical and structural characteristics of being created by a single layer deposition process.

Figure 10:
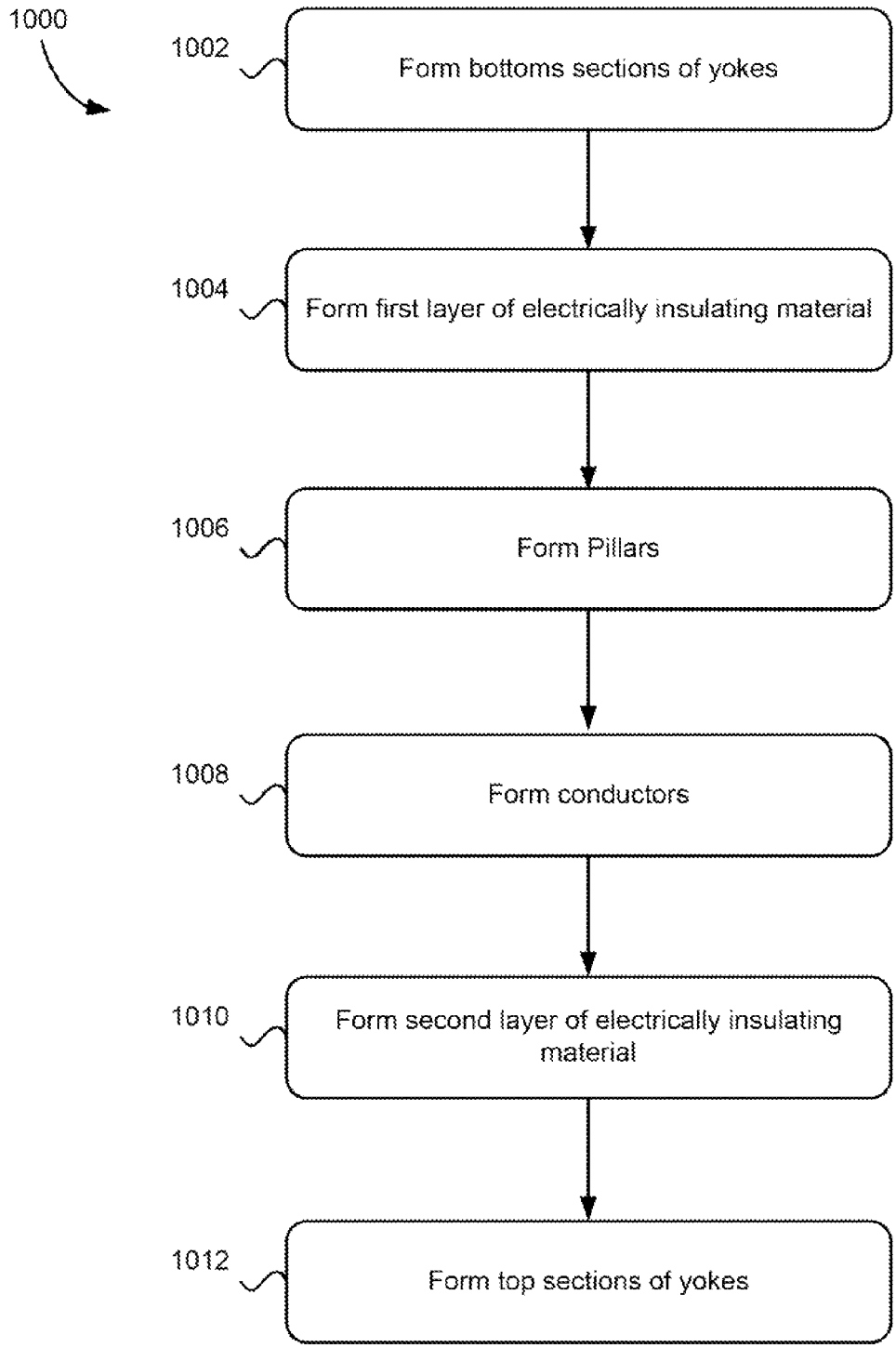
FIG. 10 is a flowchart of a method according to one embodiment.

In other embodiments, the non-magnetic gaps may be made of an electrically conductive material known in the art, such as ruthenium, tantalum, aluminum, etc.

Where the top section of each yoke is planar, e.g., as in FIGS. 7 and 8, the method may further include forming pillars of magnetic material extending between the top and bottom section of each yoke. For example, FIG. 10 depicts a method 1000 for forming an inductor as shown in FIG. 7. The method 100, in some approaches, may be performed in any desired environment, and may include embodiments and/or approaches described in relation to FIGS. 1-9. Of course, more or less operations than those shown in FIG. 10 may be performed as would be known to one of skill in the art.

In step 1002, bottom sections of two yokes are formed. Any suitable process may be used, such as plating, sputtering, masking and milling, etc. The top and bottom sections of the yokes may be constructed of any soft magnetic material, such as iron alloys, nickel alloys, cobalt alloys, ferrites, etc. The top and/or bottom sections of the yokes may be characteristic of a continuously-formed layer, or may be a laminate of magnetic and nonmagnetic layers, e.g., alternating magnetic and nonmagnetic layers. Moreover, as noted above with reference to FIG. 4, the bottom sections may be portions of a continuous layer of magnetic material.

In step 1004 of FIG. 10, a first layer of electrically insulating material is formed over at least a portion of each of the two bottom sections. Any suitable process may be used, such as sputtering, spincoating, etc. Any electrically insulating material known in the art may be used, such as alumina, silicon oxides, resists, polymers, etc. This layer may also be comprised of multiple layers of differing or similar materials so long as it is non magnetic and non conductive. The layer may optionally be used to create the gaps in the ferromagnetic yoke. The layer may also be patterned to allow gaps to be formed only where they are intended to be placed.

In step 1006, the pillars are formed. The pillars may be formed in a similar manner and/or composition as the bottom sections. In some approaches, the pillars may have a different composition than the bottom sections.

In step 1008, one or more conductors passing over each of the bottom sections and first layer of electrically insulating material is formed. The conductor(s) may be constructed of any electrically conductive material, such as copper, gold, aluminum, etc. Any known fabrication technique may be used, such as plating through a mask, Damascene processing, conductor printing, sputtering, masking and milling etc.

In step 1010, a second layer of electrically insulating material is formed above the one or more conductors. The second layer of electrically insulating material may be formed in a similar manner and/or composition as the first layer of electrically insulating material, or it may include a different material. It may include a polymer layer. This insulation layer may be subsequently planarized using a variety-planarization techniques such as chemical mechanical planarization so that the region of insulation above the conductor is planar.

In step 1012, top sections of the two yokes are formed. The top sections may be formed in a similar manner and/or composition as the bottom sections and/or pillars. In some approaches, the top sections may have a different composition than the bottom sections and/or pillars.

In any approach, the dimensions of the various parts may depend on the particular application for which the thin film inductor will be used. One skilled in the art armed with the teachings herein would be able to select suitable dimensions without needing to perform undue experimentation. As general guidance, the amount of gain is generally proportional to the size of the gap in proportion to the length of the yoke, while the larger the gap, the lower the inductance of the inductor. However, if the gap is too large, the magnetic yoke becomes less effective in increasing inductance and reducing current in the device.

Figure 11:
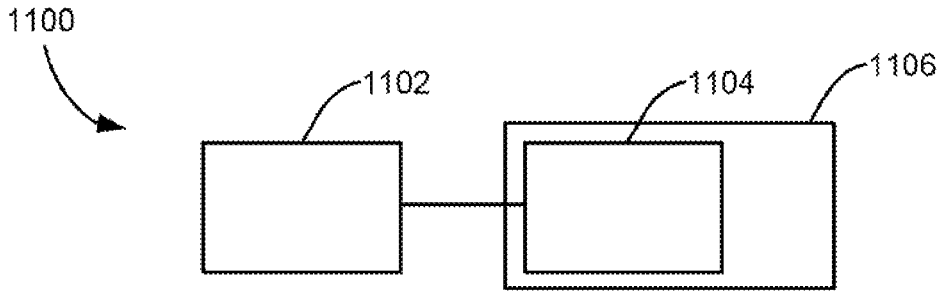
FIG. 11 is a simplified diagram of a system according to one embodiment.

In use, the thin film inductors may be used in any application in which an inductor is useful. In one general embodiment, depicted in FIG. 11, a system 1100 includes an electronic device 1102, and a thin film inductor 1104 according to any of the embodiments described herein, preferably coupled to or incorporated into a power supply 1106 of the electronic device. Such electronic device may be a circuit or component thereof, chip or component thereof, microprocessor or component thereof, application specific integrated circuit (ASIC), etc. In further embodiments, the electronic device and thin film inductor are physically constructed (formed) on a common substrate. Thus, in some approaches, the thin film inductor may be integrated in a chip, microprocessor, ASIC, etc.

Figure 12:
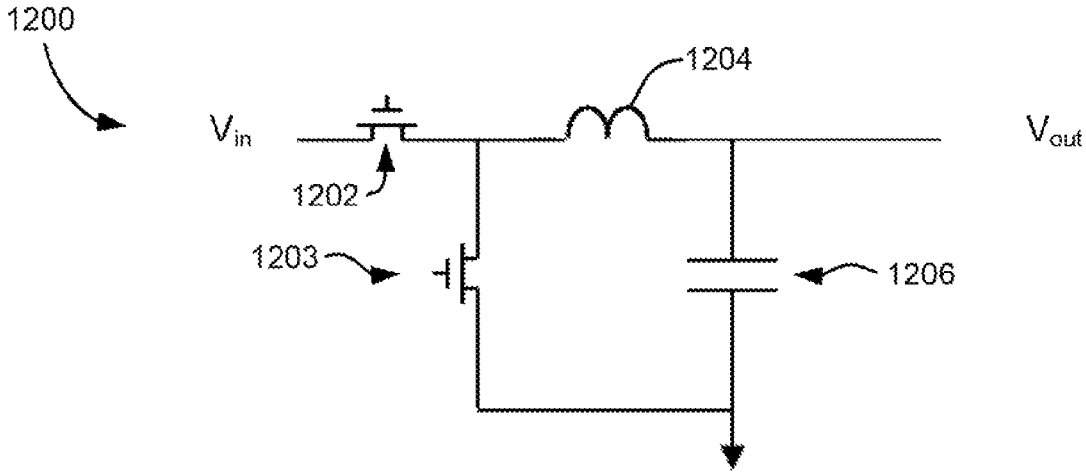
FIG. 12 is a simplified circuit diagram of a system according to one embodiment.

In one illustrative embodiment, depicted in FIG. 12, a buck converter circuit 1200 is provided. In this example the circuit includes two transistor switches 1202, 1203 the inductor 1204, and a capacitor, 1206. With appropriate control signals on the switches, this circuit will efficiently convert a larger input voltage to a smaller output voltage. Many such circuits incorporating inductors are know to those in the art. This type of circuit may be a stand alone power converter, or part of a chip or component thereof, microprocessor or component thereof, application specific integrated circuit (ASIC), etc. In further embodiments, the electronic device and thin film inductor are physically constructed (formed) on a common substrate. Thus, in some approaches, the thin film inductor may be integrated in a chip, microprocessor, ASIC, etc.

In yet other approaches, the thin film inductor may be integrated into electronics devices where they are used in circuits for applications other than power conversion. The inductor may be a separate component, or formed on the same substrate as the electronic device.

In yet another approach, the thin film inductor may be formed on a first chip that is coupled to a second chip having the electronic device. For example, the first chip may act as an interposer between the power supply and the second chip.

Illustrative systems include mobile telephones, computers, personal digital assistants (PDAs), portable electronic devices, etc. The power supply may include a power supply line, a battery, a transformer, etc.

While various embodiments have been described above, it should be understood that they have been presented by way of example only, and not limitation. Thus, the breadth and scope of an embodiment of the present invention should not be limited by any of the above-described exemplary embodiments, but should be defined only in accordance with the following claims and their equivalents.

What is claimed is:

1. A thin film inductor, comprising:

one or more arms;

one or more conductors passing through each arm;

a first ferromagnetic yoke wrapping partially around the one or more conductors in a first of the one or more arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a low reluctance path in the via regions; and one or more non-magnetic gaps between the top section and the bottom section in at least one of the via regions, wherein the first ferromagnetic yoke has a single non-magnetic gap in the ferromagnetic yoke.

2. The thin film inductor as recited in claim 1, wherein the non-magnetic gap is made of an electrically insulating material.

3. The thin film inductor as recited in claim 1, wherein the non-magnetic gap is made of an electrically conductive material.

4. The thin film inductor as recited in claim 1, further comprising a second ferromagnetic yoke wrapping partially around the one or more conductors in a second of the one or more arms, the second ferromagnetic yoke comprising a magnetic top section, a magnetic bottom section, and via regions positioned on opposites sides of the one or more conductors in the second of the one or more arms, wherein the magnetic top section and magnetic bottom section are coupled together through a low reluctance path in the via regions; and one or more non-magnetic gaps between the top section and the bottom section in at least one of the via regions of the second arm.

5. The thin film inductor as recited in claim 4, wherein each of the ferromagnetic yokes wrapping the one or more conductors in the respective arm has a single non-magnetic gap in the ferromagnetic yoke.

6. The thin film inductor as recited in claim 5, wherein the non-magnetic gap of each ferromagnetic yoke is located on an inside of the thin film inductor.

7. The thin film inductor as recited in claim 1, wherein the one or more electrical conductors has a spiral configuration.

8. The thin film inductor as recited in claim 1, wherein the coils are separated from the bottom section by an electrically insulating material, wherein the electrically insulating material forms the one or more non-magnetic gaps and has physical and structural characteristics of being created by a single layer deposition.

9. The thin film inductor as recited in claim 1, wherein the one or more electrical conductors has two or more turns.

10. The thin film inductor as recited in claim 1, wherein the top section of each yoke is conformal.

11. The thin film inductor as recited in claim 1, wherein the top section of the first ferromagnetic yoke is planar and pillars of magnetic material extend between the top and bottom section of the first ferromagnetic yoke, wherein each of the pillars is in direct contact with at least one of the sections of the first ferromagnetic yoke.

12. The thin film inductor as recited in claim 11, wherein the one or more nonmagnetic gaps of the first ferromagnetic yoke are at the bottom of the pillar or pillars.

13. The thin film inductor as recited in claim 11, wherein the one or more nonmagnetic gaps of the first ferromagnetic yoke are at the top of the pillar or pillars.

14. The thin film inductor as recited in claim 4, wherein at least one of the top sections and the bottom sections of the first and second ferromagnetic yokes is continuous across the first and second yokes.

15. A thin film inductor, comprising:

one or more arms;

one or more conductors passing through each arm;

a first ferromagnetic yoke wrapping partially around the one or more conductors in a first of the one or more arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a low reluctance path in the via regions; and one or more non-magnetic gaps between the top section and the bottom section in at least one of the via regions, wherein at least one of the top sections and the bottom sections of the first ferromagnetic yoke is a laminate of at least two magnetic layers and at least one nonmagnetic layer positioned between the magnetic layers.

16. The thin film inductor as recited in claim 15, wherein the top section and bottom section of the first ferromagnetic yoke are separated by two non-magnetic gaps.

17. The thin film inductor as recited in claim 16, wherein the two non-magnetic gaps are of different thickness.

18. The thin film inductor as recited in claim 15, wherein the one or more non-magnetic gaps are made of an electrically conductive material.

19. A system, comprising:

an electronic device; and a power supply incorporating a thin film inductor, the thin film inductor comprising:

at least two arms;

one or more conductors passing through each arm;

a first ferromagnetic yoke wrapping partially around the one or more conductors in a first of the arms, the first ferromagnetic yoke comprising a magnetic top section, a magnetic bottom section, and via regions positioned on opposites sides of the one or more conductors in the first of the one or more arms, wherein the magnetic top section and magnetic bottom section are coupled together through a first low reluctance path in the via regions; and one or more non-magnetic gaps between the top section and the bottom section in at least one of the via regions of the first arm;

a second ferromagnetic yoke wrapping partially around the one or more conductors in a second of the arms, the second ferromagnetic yoke comprising a magnetic top section, a magnetic bottom section, and via regions positioned on opposites sides of the one or more conductors in the second of the one or more arms, wherein the magnetic top section and magnetic bottom section are coupled together through a second low reluctance path in the via regions; and one or more non-magnetic gaps between the top section and the bottom section in at least one of the via regions of the second arm, wherein the one or more non-magnetic gaps are made of an electrically conductive material.

20. The system as recited in claim 19, wherein the top section of each yoke is conformal.

21. The system as recited in claim 19, wherein the top section of each yoke is planar and pillars of magnetic material extend between the top and bottom section of each yoke, wherein each of the pillars is in direct contact with at least one of the sections of the first ferromagnetic yoke.

22. The system as recited in claim 19, wherein at least one of the top sections and the bottom sections of the first and second yokes is a laminate of at least two magnetic layers and a nonmagnetic layer positioned between the magnetic-layers.

23. The system as recited in claim 19, wherein the thin film inductor and the electronic device are physically constructed on a common substrate.

24. A method of making a thin film inductor, the method comprising:

forming bottom sections of two yokes;

forming a first layer of electrically insulating material over at least a portion of each of the two bottom sections;

forming one or more conductors passing over each of the bottom sections;

forming a second layer of electrically insulating material above the one or more conductors; and forming top sections of the two yokes, wherein one or more non-magnetic gaps are present in one or more via regions, the via regions being positioned on each side of the one or more conductors between the top section and the bottom section of each yoke, wherein the one or more non-magnetic gaps are made of an electrically conductive material.

25. The method of making a thin film inductor according to claim 24, wherein the top section of each yoke is planar, and further comprising forming pillars of magnetic material extending between the top and bottom section of each yoke, wherein each of the pillars is in direct contact with at least one of the sections of the yoke associated therewith.

* * * * *